United States Patent [19]

Hagan

[11] Patent Number: 4,850,336

[45] Date of Patent: Jul. 25, 1989

[54] FLUE CONTROL DEVICE

[75] Inventor: Grant E. Hagan, Surrey, Canada

[73] Assignee: Sankyo Manufacturing Company, Ltd., Tokyo, Japan

[21] Appl. No.: 281,922

[22] Filed: Dec. 5, 1988

Related U.S. Application Data

[63] Continuation of Ser. No. 62,864, Jun. 16, 1987, abandoned.

[51] Int. Cl.[4] ..... F23J 11/00

[52] U.S. Cl. ..... 126/307 R; 126/297; 122/155 A; 138/46

[58] Field of Search ..... 34/86, 235; 29/157.3 AH; 110/184, 213, 254; 122/16, 17, 20 B, 44 A, 136 C, 155 A; 126/292, 99 R, 296, 297, 307 R, 307 A, 315; 138/38, 42, 43, 46; 165/109.1, 901

[56] References Cited

U.S. PATENT DOCUMENTS

| | | | |
|---|---|---|---|
| 153,082 | 7/1874 | Johnson | 126/297 |
| 293,893 | 2/1884 | Lindley et al. | 126/307 R |
| 335,631 | 2/1886 | Root | 126/307 R |
| 432,544 | 7/1890 | Moore | 122/155 A |
| 660,761 | 10/1900 | Seyfarth | 138/38 |
| 1,120,550 | 10/1911 | Schulz | 138/38 |
| 1,332,746 | 3/1920 | Oberg | 138/38 |
| 2,020,194 | 7/1932 | Kuhlmann | 122/44 A |
| 3,052,230 | 9/1962 | Conrad | 126/307 |
| 4,044,796 | 8/1977 | Smick | 138/38 |

FOREIGN PATENT DOCUMENTS

| | | | |
|---|---|---|---|
| 83265 | 11/1919 | Switzerland . | |
| 666 | 4/1904 | United Kingdom | 126/307 R |

*Primary Examiner*—Noah P. Kamen

*Attorney, Agent, or Firm*—Pollock, Vande Sande & Priddy

[57] ABSTRACT

A device for adjustably restricting the flow of exhaust gases in a furnace flue to conserve fuel is disclosed. It comprises two interlocking pipe sections and a helical element having one end fixed to the inner surface of each pipe section. The helical element has a circular opening along its central axis. The degree of restriction provided by the device is adjusted by twisting or separating the two pipe sections.

4 Claims, 2 Drawing Sheets

FLUE CONTROL DEVICE

This is a continuation of application Ser. No. 062,864, filed June 16, 1987, abandoned.

BACKGROUND OF THE INVENTION

The invention relates to a device for improving the combustion efficiency of furnaces by controlling the flow of exhaust gases from the flue.

It is known that the efficiency of hydrocarbon fueled combustion furnaces is reduced through the loss of incompletely-combusted gases and heat up the exhaust flue of the furnace. It is further known that the efficiency of the furnace may be improved by interrupting the flow of exhaust gases from the furnace, thus causing the exhaust gases to dwell longer in the furnace and be more completely combusted. For example, U.S. Pat. No. 4,291,671 issued Sep. 29, 1981 to Senne discloses a baffle plate which is inserted into the path of the exhaust gases, causing eddy currents to be created and increasing the resistance to flow of the exhaust gases, thereby improving combustion efficiency in the furnace.

At the same time there are practical restrictions on the extent to which the exhaust gas flow may be restricted. Overly restricting the flow of exhaust gases may cause a high pressure build-up of combustible gases in the furnace which increases the risk of explosion. Consequently authorities have regulated the extent to which devices may restrict the exhaust flow. Such devices, however, in the past have not been readily adjustable to increase or decrease the amount by which the device restricts the exhaust gas flow.

Helical radiators have also been utilized in the flues of stoves or chimneys to increase the heat transfer between the exhaust gases and the stove pipe and thus increase the radiation of the heat to the room to be heated. An example of such a radiator is shown in U.S. Pat. No. 799,120 issued Sep. 12, 1905 to Way. Such radiators, however, have not been designed for modern gas furnaces and would be overly restrictive and dangerous if used in modern furnaces.

SUMMARY OF THE INVENTION

The present invention provides a flue control device which improves the combustion efficiency of the furnace within safety guidelines and which is readily adjustable. The device comprises two interlocking pipe sections, and a spiral coil having a diameter slightly less than the inner diameter of the pipe sections and a central opening along the axis of the spiral. One end of the spiral coil is secured to the first pipe section and the second end is secured to the second pipe section so that the spacing of the coils of the spiral and the angle of the blades may be modified by twisting and separating the two pipe sections. The pipe sections are in turn adapted to be installed in the furnace exhaust pipe.

BRIEF DESCRIPTION OF THE DRAWINGS

An embodiment of the invention is illustrated in the accompanying drawings in which.

DETAILED DESCRIPTION OF A PREFERRED EMBODIMENT OF THE INVENTION

Figure 1:
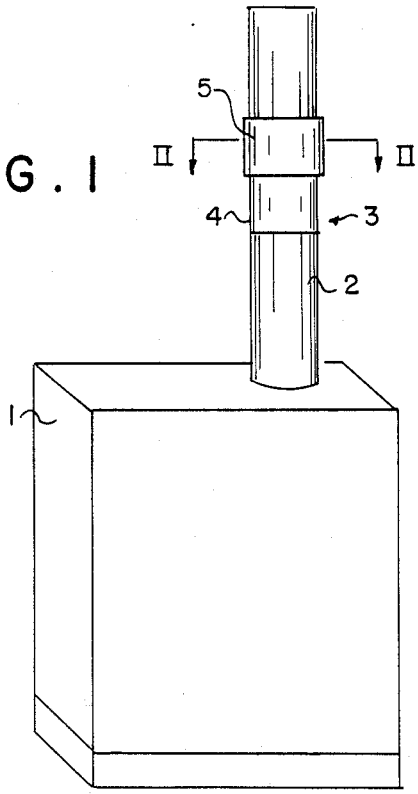
FIG. 1 is a perspective view of a typical furnace having the flue control device of the invention.

With reference to FIG. 1, a standard gas or oil-fired furnace is indicated as 1, having an exhaust stack or flue to the exterior of the building. The flue control device of the invention is illustrated at 3, consisting of pipe sections 4 and 5. The exhaust gases from the combustion process are passed out to the atmosphere through flue 2 after heat has been exchanged in the plenum of the furnace with air to be circulated in the building.

Figure 2:
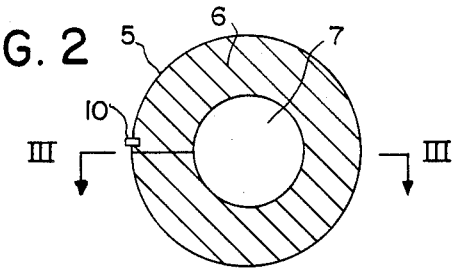
FIG. 2 is a cross-sectional view taken across lines II—II of FIG. 1; and, FIGS. 3*a*, 3*b* and 3*c* are cross-sectional views taken along III—III of FIG. 2 showing the flue control device of the invention in three adjusted positions.

FIG. 2 shows the flue control device of the present invention in cross-section, with the helical blade designated as 6 forming a central opening 7.

Figure 3A:
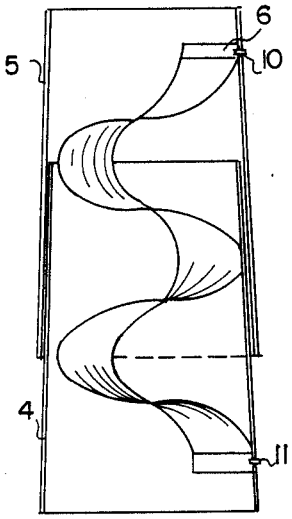

Referring to FIG. 3*a*, pipe sections 4 and 5 are shown to have a tapered shape with the lower end of pipe section 5 having an inner diameter slightly greater than the outside diameter of the upper end of pipe section 4, allowing pipe section 4 to slide freely and rotate freely inside pipe section 5. The open lower end of section 4 may fit over the end of a flue pipe section, and similarly the open end of pipe section 5 may fit inside another flue pipe to allow the unit to be installed in a furnace chimney or flue. A flexible band (not shown) is provided around the lower end of pipe section 5 with two ears which may be drawn together to tighten pipe section 5 in a fixed position relative to pipe section 4, using a nut and bolt or similar fastener to tighten the ears together.

Mounted in the interior of the two pipe sections is helical element 6. One end of helical element 6 is secured to pipe section 5 at location 10 by a screw or rivet, while the other end of the helical element is similarly fixed to pipe section 4 at location 11. Helical element 6 may be formed of two annular elements which are cut along one radius and then linked end to end, or in other known ways. The helical element is provided with a central circular opening 7 which allows a continuous rectilinear free flow of exhaust gases in the center of the chimney shown in FIG. 3*b* by shaded area 12. The helical element, however, causes a portion of the exhaust gas to follow a spiral path, creating vortices, and thus creating a certain resistance to free flow of the exhaust gases and increasing the dwell time in the furnace. Arrow A indicates the path of a portion of the exhaust gases in vortices around the central opening.

Figure 3B:
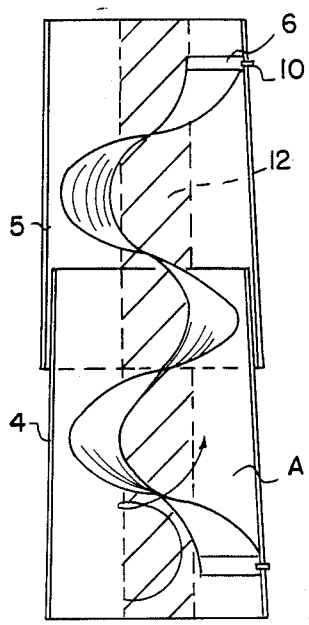
Figure 3C:
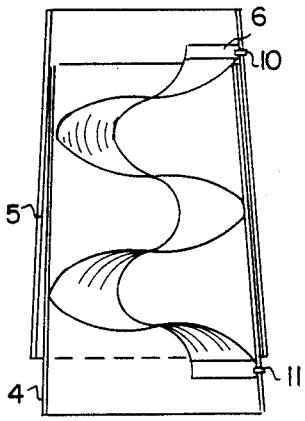

FIGS. 3*b* and 3*c* indicate the manner in which the resistance to the exhaust gas flow may be increased or decreased quite readily. By pulling pipe section 4 further out of the interior of pipe section 5, the pitch of the helical element is increased, that is, the distance between corresponding turns is increased, and accordingly the severity of the turns through which the exhaust gases must travel is decreased, thereby reducing the resistance to the flow of gases. Conversely, in FIG. 3*c*, pipe section 4 is inserted more deeply into pipe section 5, thereby tightening the pitch of the helical element and steepening the angle of the spiral turns which the exhaust gases must make, thereby increasing the resistance to free flow. At the same time, the presence of central opening 7 does not completely restrict the free flow of exhaust gases thereby complying with appropriate safety precautions.

It will be seen that the resistance to exhaust gas flow may also be varied or adjusted by rotating pipe section 4 relative to pipe section 5, thereby increasing the number of turns of helical element 6 per unit length, or decreasing the number of terms per unit length, and thereby either increasing or decreasing the number of spiral turns per unit length which the exhaust gases must follow and thus increasing or decreasing the resistance to gas flow.

In the preferred form of the invention, central opening 7 has a diameter which is approximately one-half the outside diameter of the helical element, although this clearly would be reduced to one quarter or less depending on the applicable regulations. A helical element in which the surface turns through 720 degrees is also preferred.

To install the unit, pipe sections 4 and 5 are twisted and separated to the extent necessary to achieve the desired restriction on exhaust gas flow. The band is then tightened around the lower end of section 5 to temporarily secure the relative positions of the sections. The unit can then be installed in the flue pipe and screwed or pop rivetted in place and screws or rivets used to fix the relative position of the two sections.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A method of variably controlling the flow of exhaust gases from a furnace flue pipe comprising the steps of:

(a) providing in said flue pipe a telescoping flue pipe section comprising inner and outer cylindrical flue pipe sections, the relative longitudinal and rotational position of said inner section within said outer section being slidingly adjustable, and means for releasably securing said inner and outer sections in fixed relative longitudinal and rotational positions;

(b) providing a helical element along the central axis of said telescoping flue pipe section, said helical element having an inner diameter providing an area of open flow of gases along the central axis of said telescoping pipe section and an outer diameter slightly less than the inner diameter of said telescoping pipe section;

(c) fixing one end of said helical element to a point on the interior surface of said inner pipe section and fixing the second end of said helical element to a point on the interior surface of said outer pipe section;

(d) adjusting the relative longitudinal and rotational positions of said inner and outer sections to obtain the desired restriction on the flow of gases in said flue pipe; and (e) securing said inner and outer pipe sections in the desired position.

2. The method of claim 1 wherein said inner diameter of said helical element is greater than approximately one quarter of the inner diameter of said telescoping pipe sections.

3. The method of claim 1 wherein said inner diameter of said helical element is approximately one half of the inner diameter of said telescoping pipe sections.

4. The method of claim 1 wherein said helical element forms a spiral which rotates through 720 degrees.

* * * * *

UNITED STATES PATENT AND TRADEMARK OFFICE

CERTIFICATE OF CORRECTION

PATENT NO. : 4,850,336

DATED : July 25, 1989

INVENTOR(S) : Grant E. Hagan

It is certified that error appears in the above-identified patent and that said Letters Patent is hereby corrected as shown below:

On the title page Item [73] should be deleted.

Signed and Sealed this

Ninth Day of October, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,850,336

DATED : July 25, 1989

INVENTOR(S) : Grant E. Hagan

It is certified that error appears in the above-identified patent and that said Letters Patent is hereby corrected as shown below:

Title page: please delete "Pollock, Vande Sande & Priddy" as the Attorney, Agent, or Firm and insert instead --Merchant, Gould, Smith, Edell, Welter & Schmidt, P.A.--

Signed and Sealed this

Eighth Day of January, 1991

*Attest:*

HARRY F. MANBECK, JR.

*Attesting Officer*

*Commissioner of Patents and Trademarks*